United States Patent [19]

Lindstrom

[11] Patent Number: 4,742,627

[45] Date of Patent: May 10, 1988

[54] DIGGING BOOM ASSEMBLY

[75] Inventor: Edgar K. Lindstrom, Wichita, Kans.

[73] Assignee: J. I. Case Company, Racine, Wis.

[21] Appl. No.: 911,174

[22] Filed: Sep. 24, 1986

[51] Int. Cl.[4] ..... E02F 5/06

[52] U.S. Cl. ..... 37/86; 37/83

[58] Field of Search ..... 37/83, 86, 80 R, 80 A, 37/87, 189, 190

[56] References Cited

U.S. PATENT DOCUMENTS

| | | | |
|---|---|---|---|
| 3,209,473 | 10/1965 | Davis | 37/86 |
| 3,528,078 | 9/1970 | Taylor | 37/86 |
| 3,550,294 | 12/1970 | Fewell | 37/86 X |
| 3,603,010 | 9/1971 | Polinek | 37/83 |
| 3,623,246 | 11/1971 | Skomial et al. | 37/86 |
| 4,164,082 | 8/1979 | Watson | 37/83 |

*Primary Examiner*—Edgar S. Burr
*Assistant Examiner*—Moshe I. Cohen
*Attorney, Agent, or Firm*—Cullen, Sloman, Cantor, Grauer, Scott & Rutherford

[57] ABSTRACT

A digging boom assembly including a first section which is attached to a trencher and a second section that may be disconnected from the first section and replaced with another identically configured section of longer or shorter length. The boom assembly is attached to the trencher such that the first section always remains connected to the trencher while the second section may be selectively exchanged with another section of a different length thereby permitting variable digging depths. An auger attachment and a crumber attachment are connected to the first boom section, which remains attached to the trencher at all times. Thus, when the second boom section is disconnected and replaced with another section of longer or shorter length, the auger and crumber attachments do not have to be disassembled from the boom assembly.

1 Claim, 2 Drawing Sheets

DIGGING BOOM ASSEMBLY

BACKGROUND OF THE INVENTION

The present invention relates to a digging boom assembly which is made in two sections with one section remaining attached to a trencher and the other section being exchangeable for one of a different length to permit varying digging depths.

It is conventional in trenching operations to provide a plurality of boom assemblies, including boom assemblies of different lengths, for the trenching machine. These various boom assemblies are changed depending upon the working conditions in the ground and the desired digging depth. Changing from one boom assembly to another is a problem because of the time and labor expanded in the changeover. Moreover, the auger and crumber attachments must be disconnected from the used boom assembly and reconnected to the new boom assembly which is difficult because these attachments are heavy and awkward to manipulate.

Thus, the disadvantages of conventional trencher digging booms have resulted in the present digging boom assembly which eliminates the necessity of removing the auger and crumber attachment when the length of the boom assembly is changed.

SUMMARY OF THE INVENTION

The variable length digging boom of the present invention includes a first section which is attached to a trencher and a second section that may be disconnected from the first section and replaced with another identically configured section of longer or shorter length. Thus, the boom assembly is attached to the trencher such that the first section always remains connected to the trencher while the second section may be selectively exchanged with another section of a different length, thereby permitting variable digging depths.

The boom assembly section which is connected to the trencher includes a transversely disposed mounting portion for permitting the attachment of the variable length boom section. To facilitate such connection, the variable length boom section has a L-shaped end plate that is adapted for quick coupling to or uncoupling from the first boom section without the need for special tools or complicated coupling procedures.

A particular advantage of the boom assembly is that the auger attachment and crumber attachment are connected to the first boom section which remains attached to the trencher at all times. This obviates the prior problem of having to entirely disconnect and reconnect the auger and crumber when a different length boom is desired. In the present construction, the variable length boom section is disconnected and replaced with another section of longer or shorter length without the need for manipulating the auger and crumber attachments in any way.

The auger attachment includes a central shaft and a centrally located sprocket with the auger shaft being supported by bearings that are connected to the underside of the first boom section. Further, the mounting portion of the first boom section includes end plates which are laterally spaced for the purpose of connecting depending legs of the crumber attachment. Thus, the second boom section may be removed and replaced with another section of different length without the need for disassembling the auger or crumber attachments.

Other advantages and meritorious features of the digging boom assembly will be more fully understood from the following description of the invention, the appended claims, and the drawings, a brief description of which follows.

DESCRIPTION OF THE INVENTION

Figure 1:
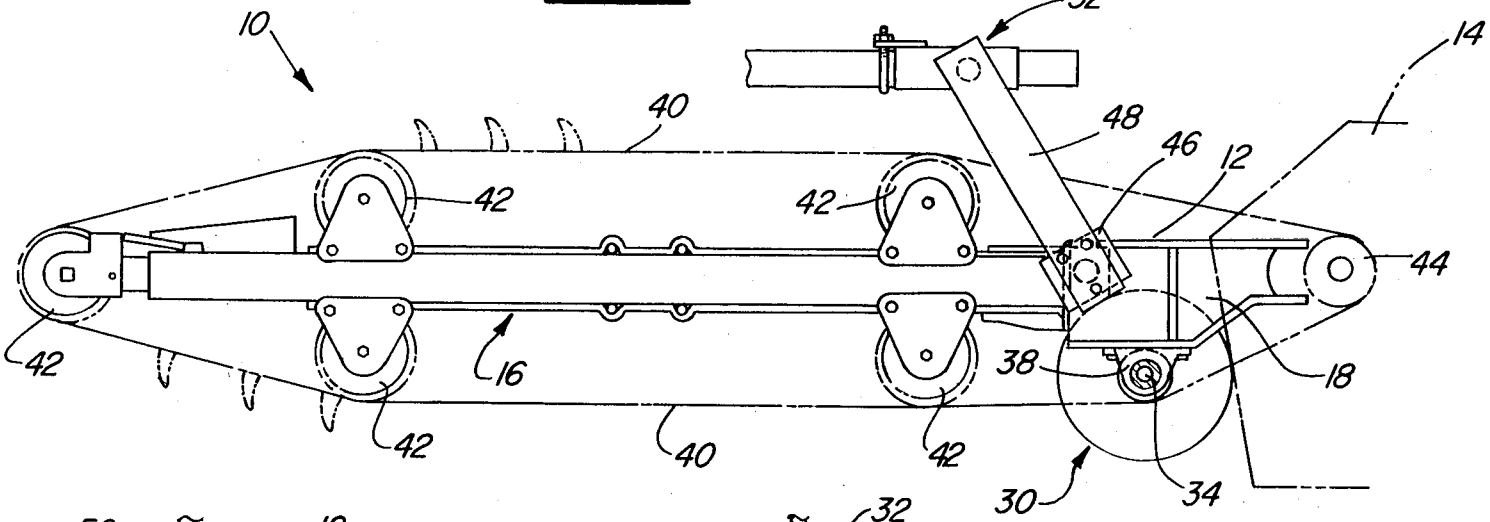
FIG. 1 is a side elevational view of the digging boom assembly of the present invention.
Figure 2:
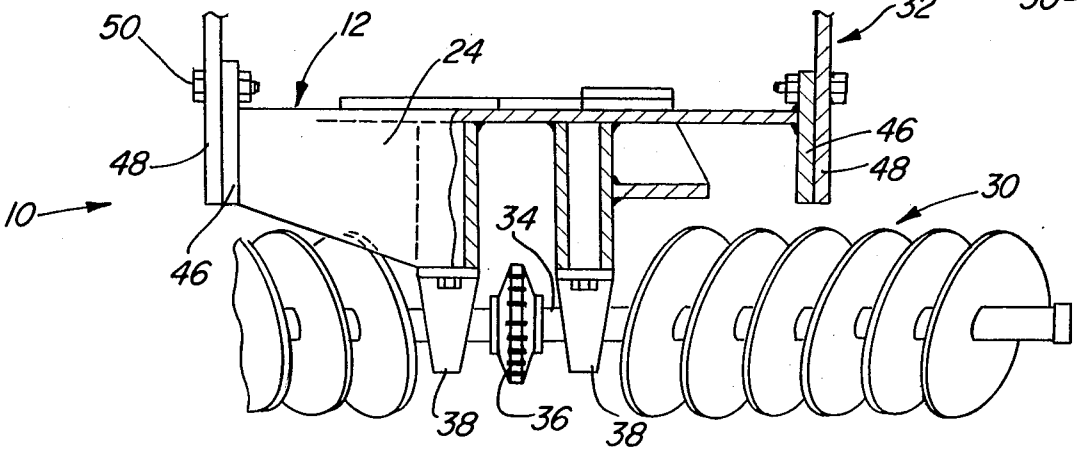
FIG. 2 is a partial cross-sectional view illustrating the connection between the auger attachment of the first boom section.
Figure 3:
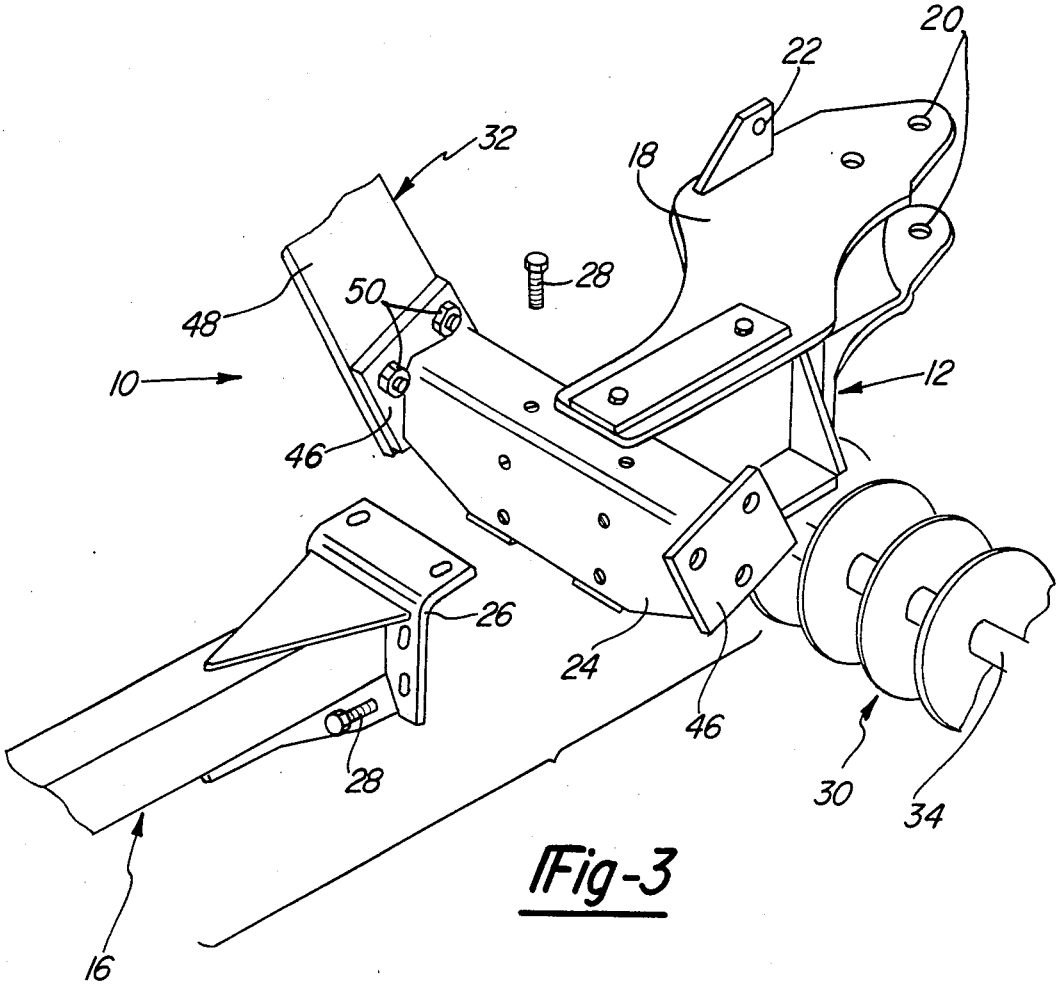
FIG. 3 is a partial assembly view illustrating the attachment between the first and second boom sections.

The variable length digging boom assembly 10 of the present invention is illustrated in FIGS. 1–3. It includes a first section 12, which is attached to a trencher 14, and a second section 16 that may be disconnected from the first section and replaced with another identically configured section of longer or shorter length. Thus, the boom assembly 10 is attached to the trencher 14 such that the first section 12 always remains connected to the trencher while the second section 16 may be selectively exchanged with another section of a different length, thereby permitting variable digging depths.

Referring to FIG. 3, boom section 12 includes an attachment portion 18 which is connected to trencher 14 at attaching points 20 and 22 for mounting the bottom assembly to the trencher frame. Section 12 further includes a transversely disposed, box-like mounting portion 24 for permitting the attachment of boom section 16 to boom section 12. To facilitate such connection, boom section 16 has a L-shaped end plate 26 that engages the top and a side surface of portion 24 with plate 26 being connected to portion 24 by fasteners 28. Thus, boom section 16 is adapted for quick coupling to or uncoupling from boom section 12 without the need for special tools or complicated coupling procedures.

A particular advantage resulting from the boom assembly 10 is that the auger attachment 30 and crumber attachment 32 are connected to boom section 12, which remains attached to trencher 14 at all times. This obviates the prior problem of having to entirely disconnect and reconnect the auger and crumber attachments when a different length boom is desired. In the present construction, boom section 16 is disconnected and replaced with another section of larger or shorter length without the need for manipulating the auger and crumber attachments 30 and 32 in any way.

As shown in FIG. 2, the auger attachment 30 includes a central shaft 34 and a centrally located sprocket 36 on shaft 34. Auger shaft 34 is supported by bearings 38 which are connected to the underside of boom section 12. The digging chain 40 is connected to sprocket 36 and to the other sprockets 42 along the length of boom assembly 10 with chain 40 being driven by a motor drive sprocket 44 on trencher 14.

Referring again to FIG. 3, mounting portion 24 includes end plates 46 which are laterally spaced relative to attachment portion 18 for the purpose of connecting the depending legs 48 of crumber 32 thereto by means of fasteners 50. As is conventional, the crumber attachment 32, which is only partially shown in FIGS. 1 and 3, is used to clean the bottom of the trench during a digging operation. As set forth previously, an advantage from the present construction results from the ability to replace boom section 16 with another section without the requirement of disassembling the crumber attachment 32 or auger attachment 30.

It will be apparent to those skilled in the art that the foregoing disclosure is exemplary in nature rather than limiting, the invention being limited only by the appended claims.

I claim:

1. A digging boom assembly which is adapted for mounting various lengths of digging chains to a trencher machine, said boom assembly comprising a first boom section attached to said trencher machine and means for mounting a second boom section to said first boom section such that said second boom section may be disconnected from the first boom section and replaced with another boom section of longer or shorter length;

said boom assembly further including auger and crumber attachments connected to said first boom section whereby said second boom section may be disconnected and replaced with another section of longer or shorter length without the need for disassembling said auger and crumber attachments;

said first boom section includes an attachment portion connected to said trencher machine and a transversely disposed mounting portion having top and side surfaces for attachment of said second boom section, and said means for mounting said second boom section engaging the top and a side surface of said mounting portion, and said auger attachment connected to the underside of said first boom section and including a transverse shaft having a sprocket mounted thereto at a central location for connection with a digging chain; and said first boom section mounting portion includes end members which are laterally spaced relative to said attachment portion and depending leg portions of said crumber attachment connected to said end members.

* * * * *